US010276333B2

(12) United States Patent
Paine

(10) Patent No.: US 10,276,333 B2
(45) Date of Patent: Apr. 30, 2019

(54) METHOD OF MODIFYING AN AIRCRAFT SWITCH

(71) Applicant: Alan Paine, San Dimas, CA (US)

(72) Inventor: Alan Paine, San Dimas, CA (US)

( * ) Notice: Subject to any disclaimer, the term of this patent is extended or adjusted under 35 U.S.C. 154(b) by 297 days.

(21) Appl. No.: 15/283,692

(22) Filed: Oct. 3, 2016

(65) Prior Publication Data

US 2017/0110272 A1 Apr. 20, 2017

Related U.S. Application Data

(60) Provisional application No. 62/242,131, filed on Oct. 15, 2015.

(51) Int. Cl.

| | |
|---|---|
| ***H01H 11/00*** | (2006.01) |
| ***H01H 23/06*** | (2006.01) |
| ***H01H 23/14*** | (2006.01) |

(52) U.S. Cl.

CPC ..... *H01H 23/06* (2013.01); *H01H 11/0006* (2013.01); *H01H 23/145* (2013.01); *H01H 2223/002* (2013.01); *H01H 2231/016* (2013.01); *Y10T 29/49105* (2015.01)

(58) Field of Classification Search

CPC ..... H01H 11/0006; H01H 2223/002; H01H 23/06; H01H 23/145; Y10T 29/49105; Y10T 29/49155

USPC ..... 29/622, 402.01, 402.03, 592.1, 874

See application file for complete search history.

(56) References Cited

U.S. PATENT DOCUMENTS

| | | | | |
|---|---|---|---|---|
| 5,626,222 | A | 5/1997 | Aguilera | |
| 6,121,561 | A * | 9/2000 | Sweeney | H01H 13/063 200/302.1 |
| 7,732,722 | B1 | 6/2010 | Singh et al. | |
| 9,013,254 | B2 * | 4/2015 | Molyneux | H05K 5/06 335/205 |

* cited by examiner

*Primary Examiner* — Thiem D Phan

(74) *Attorney, Agent, or Firm* — Kirk A. Buhler; Buhler & Associates

(57) ABSTRACT

Improvements a modified aircraft switch to protect from Foreign Object Debris (FOD) failure. The aircraft switch is manufactured from the factory as a new OEM switch, but can also be modified from a pre-existing switch. The switch and method to modify a switch to protect a widely used existing switch in military and commercial aircraft that is failing from Foreign Object Debris intrusion and failure from FOD.

9 Claims, 5 Drawing Sheets

General:
Sealed rocker switch Force Switch Corp. model F8100 Rev.C. AML20 series (AML24EBA3DC05S) Essex P/N C6035-1 that conforms to the requirements of MIL-DTL-3950H, QPC6035-1

Mechanical:
*Material Properties* Materials used in this switch shall not emit toxic or nauseating gases when subjected to temperatures of 400 – 700 degrees Fahrenheit. All parts shall be corrosion resistant and shall meet the guidelines of MIL-E-5400. All fasteners shall be stainless steel.
*Construction.* Environmentally sealed. Weight 25 grams MAX.
*Operation.* Resistance force shall be 10 oz. minimum or 40 oz. maximum.
*Color and Marking*: The housing, button cap and bezel color shall be black. Terminal pins permanently marked.
*Mechanical Life.* The rocker switch shall have a mechanical life of at least 40,000 cycles (20,000 ea. position) half at -54C and half at +71°C. Per MIL-DTL-3950H para 4.8.10.
*Electrical Life:* Electrical life of at least 40,000 cycles (20,000 ea. position) and shall conform to MIL-PRF-8805.

Environmental:
*Temperature Requirements:* Operational temperature range of -54°C to +71°C storage temperature of -57°C to +85°C.
*Relative Humidity:* Operational at 100% RH.
*Pressure Altitude.* Operational from sea level up to 60,000 feet.

Qualification Requirements:
*Solderability:* Per MIL-DTL-3950H para 4.8.2 and Table 2.
*Resistance to Soldering Heat.* Per MIL-DTL-3950H para 4.8.3 and Table 2.
*Switching Characteristics:* Per MIL-DTL-3950H para 4.8.4 and Table 2.
*Contact Voltage Drop:* Per MIL-DTL-3950H para 4.8.8 and Table 2. Contact voltage drop shall not exceed 2.5 millivolts.
*Mechanical Endurance.* Per MIL-DTL-3950H para 4.8.10 and Table 2. Contact voltage drop shall not exceed 5 millivolts after mechanical endurance.
*Short Circuit:* Per MIL-DTL-3950H para 4.8.12 and Table 2.
*Vibration:* Per MIL-DTL-3950H para 4.8.13 and Table 2.
*Shock:* Per MIL-DTL-3950H para 4.8.14 and Table 2. No separation of closed contacts or closure of open contacts in excess of 10 microseconds and no damage to the switch.
*Salt Spray:* Per MIL-DTL-3950 para 4.8.15 and Table 2. No warping, cracking, excessive corrosion, or damage, and the specified cycling shall be completed without failure.
*Thermal Shock:* Per MIL-DTL-3950H para 4.8.16 and Table 2. Meet in accordance with method 107 of MIL-STD-202.
*Moisture Resistance:* Per MIL-DTL-3950H para 4.8.17 and Table 2.
*Dielectric Withstanding Voltage:* Per MIL-DTL-3950H para 4.8.9 and Table 2. Switch shall meet withstand the application of the specific voltages without arching, flashover, breakdown of insulation, or damage and momentary flashover or leakage current in excess of five hundred microamperes.
*Dust Blowing:* Per IEC STD. 60529 IP57.
*Switching Characteristics.* Per MIL-DTL-3950H para 4.8.4 and Table 2.
*Switch Sealing.* Per IEC STD. 60529 IP57.

FIG. 7

| Step | Description | Op | Insp. |
|---|---|---|---|
| 1 | Remove switch from bag, record date code_____ verify no damage or missing parts | | |
| 2 | Disassemble remove actuator,spring ,pivot and bearing using tool F8133 & F8134 refer SOP 8110 | | |
| 3 | | | |
| 4 | Steam clean D.I water both sides, dry 1 hr 155F Blue M 2. SOP 8112 | | |
| 5 | Inspect switch for cleanliness using scope Insp. | | * |
| 6 | Fixture 3C switch and cool to 40-55 deg F. apply adhesive #3314 mix and apply per SOP. bake 3 hrs 184deg F | | |
| 7 | Pressure test 17psi use xtreme klean can difluoroethan,verify seal pressurize to 19-20 psi on F8135 gage. bleedoff rate 0.1 psi/sec pass | | |
| 8 | Outgas mixed silicone Q3 per E-2101. install per dwg 8104 cure 2 hr incubator 2 | | |
| 9 | Install center bearing , and bond gasket dwg. 8104 cure 6 hrs.remove from incubator 2 | | |
| 10 | Install actuator w/spring | | |
| 11 | Insp. seal Insp. | | * |
| 12 | Install dust shield and bezel use 3210 adhesive, install test rocker button | | |
| 13 | Verify rocker dust shield fit Insp. | | * |
| 14 | Install clips | | |
| 15 | Thermal cycle -60F to 180F , Perform cycle test run min 10 cycles , plug in connector, and record<br>insulation resistance <100mohms @50vdc _____ 8 pos. <0.006 ohms _____<br>detent _____ : force actuation _____ < than 1050 grams | | |
| 16 | Final insp. Verify the following and record: | | * |

force actuation _____ less than 1050 grams detent _____ insulation resistance <100mohms @50vdc _____ 8 pos.

contacts <0.006 ohms pos 2

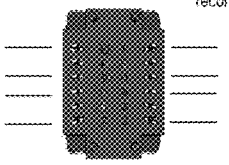

pos 1 record gram force: _____ pos 1

_____ pos 2

ID and package _____

2 less than .800 less than 1.200

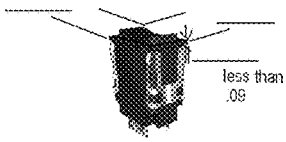

less than .06

FIG. 8

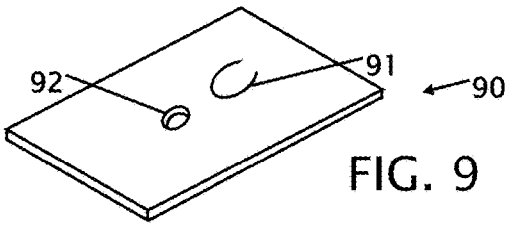

FIG. 9

METHOD OF MODIFYING AN AIRCRAFT SWITCH

CROSS REFERENCE TO RELATED APPLICATIONS

This application claims the benefit of Provisional Application Ser. No 62/242,131 filed Oct. 15, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a modified Aircraft Switch. More particularly, the present modified aircraft switch improves the sealing of the switch to prevent pre-mature failure due to foreign objection debris (FOD) intrusion.

Description of Related Art Including Information Disclosed Under 37 CFR 1.97 and 1.98.

Military and other aircrafts use a number of switches to control the aircraft and instruments. One of the most common types of this switch are AML series 20 that is a three—position, four-pole self-centering rocker switch. The switch has 12 contact pins that fits a large number of aircraft. While this document identifies modification of the switch, the switch could be manufactured in the same or similar sealed arrangement identified in this document.

A number of patents and or publications have been made to address these issues. Exemplary examples of patents and or publication that try to address this/these problem(s) are identified and discussed below.

U.S. Pat. No. 7,732,722 issued on Jun. 8, 2010 discloses a Hermetically sealed pressure switch with composite actuation mechanism and U.S. Pat. No. 6,121,561 issued on Sep. 19, 2000 discloses a disclose Hermetically sealed electrical switch. While these patents disclose sealed switches, the switches are not drop-in replacement for switches used in aircraft.

What is needed is sealed switch used in aircraft where the switch is manufactured as a sealed switch or is modified to create a sealed switch that is not effected by foreign contamination. The proposed switch provides a solution.

BRIEF SUMMARY OF THE INVENTION

It is an object of the modified aircraft switch to protect from Foreign Object Debris (FOD) failure. One of the primary reasons for failure of a switch is from foreign debris that enters into the housing. The debris often comes from air movement around the switch. Often this debris is small enough that it moves through the edges of the switch and accumulates in the housing to cause failure.

It is another object of the modified aircraft switch to provide a method to protect a widely used existing switch in military and commercial aircraft that is failing from FOD intrusion and failure from FOD. Switch failure in military and commercial airlines can result in a catastrophic failure.

It is another object of the modified aircraft switch to include elastomeric or silicon seals that are not present in the switch. The seals allow the mechanical components to move when they are being moved and maintains the seal.

It is another object of the modified aircraft switch to utilize sealant in the terminals that exit the housings. The switch leads must pass through openings in the hard plastic housings and result in openings where contamination can enter the switch housing. Sealing these openings prevents intrusion into the openings and also locks the switch terminals into position.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 7 shows the specifications for the switch.

FIG. 8 shows a description of the process to produce the switch.

FIG. 9 shows a perspective view of the silicone membrane.

DETAILED DESCRIPTION OF THE INVENTION

Figure 1:
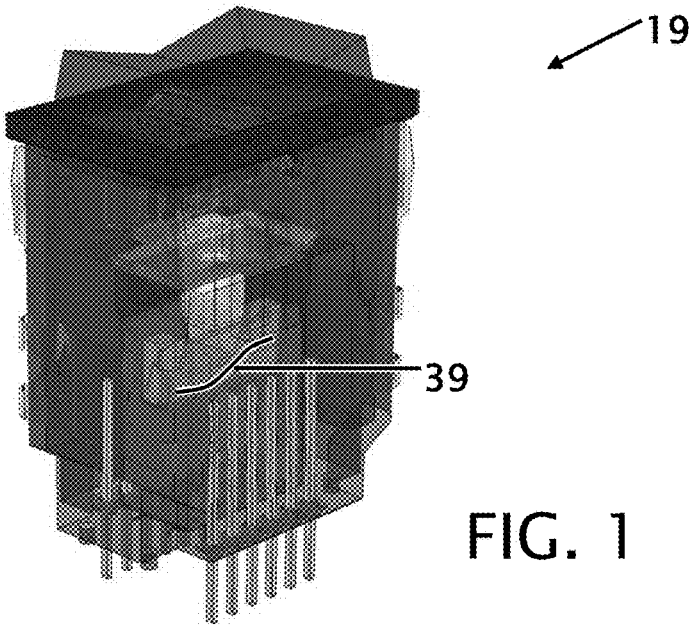
FIG. 1 shows a transparent view of sealed switch.

FIG. 1 shows a transparent view of sealed switch 19. Internally, the switch has silicone gel filled, encapsulated contacts 39 that provide some protection from contamination reaching the electrical contact.

Figure 2:
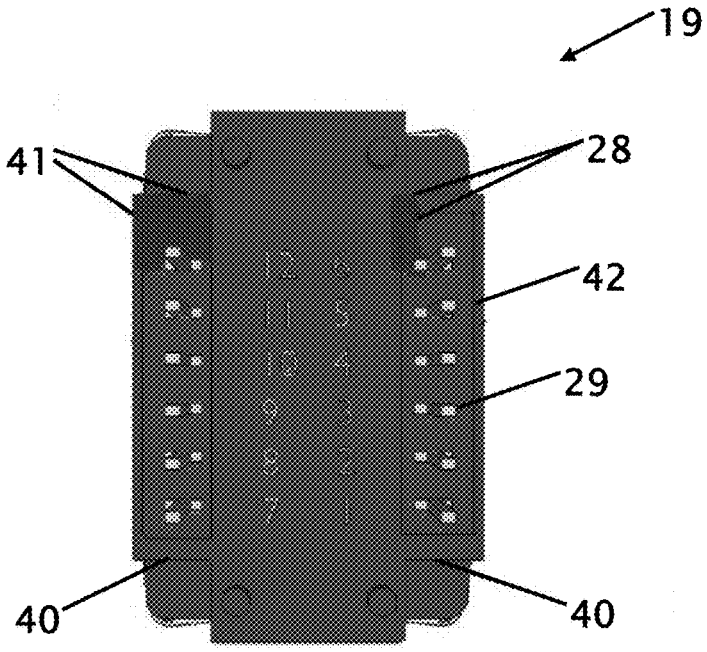
FIG. 2 shows a bottom view of the switch

FIG. 2 shows a bottom view of the switch 19. A sealing adhesive, such as #3314 red adhesive 28 is applied around the contact pins 29. The sealing adhesive 28 is also placed around the four sides 40 of the switch 19. The sealing adhesive can extend 41 to the edges of the terminal recess 42.

Figure 3:
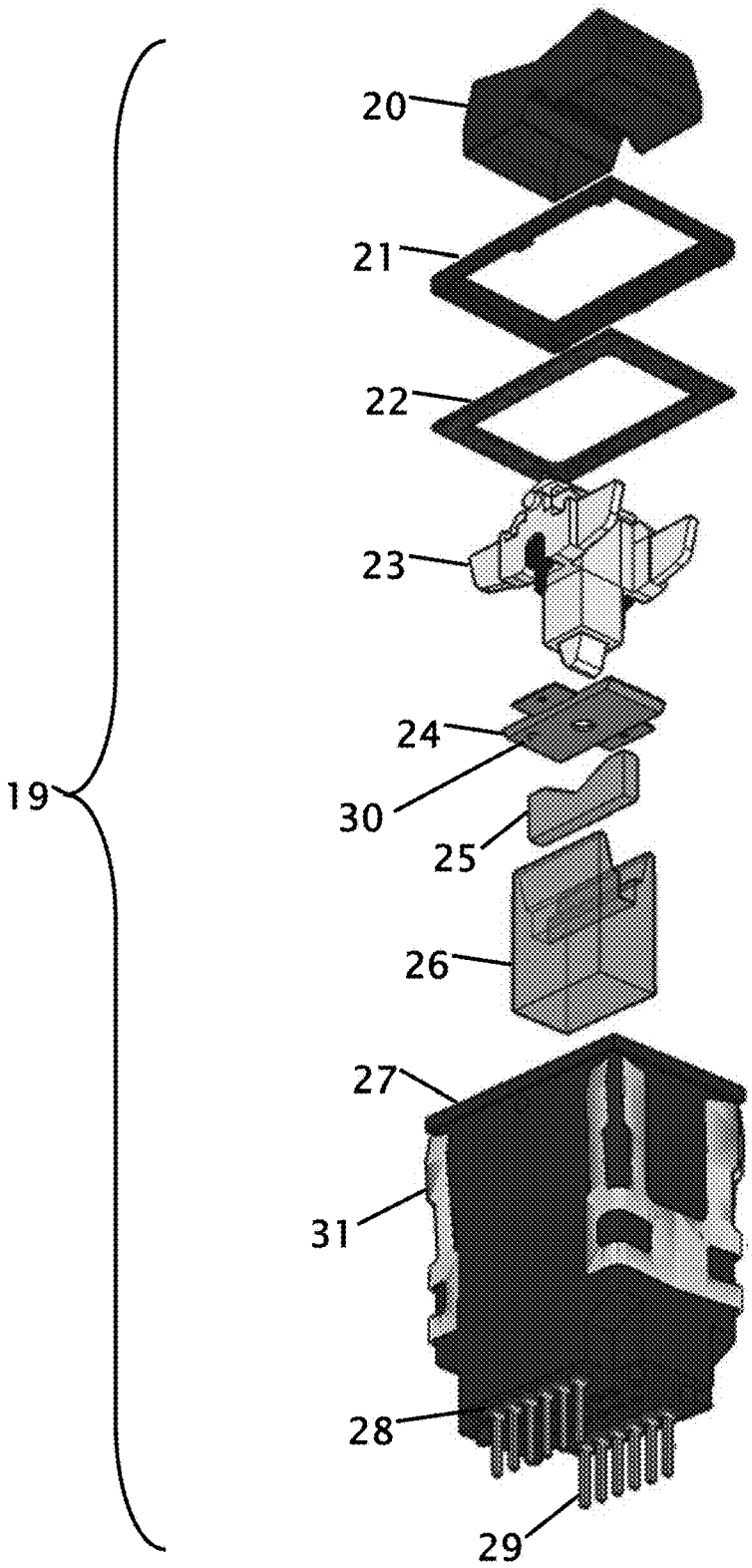
FIG. 3 shows an exploded view of the switch components.

FIG. 3 shows an exploded view of the switch components. This figure shows the rocker button 20 on top of a bezel 21 that holds and seals the rocker button opening with a dust shield 22. The top bezel is an additional improvement to the stock switch 19 and is preferably made from a stainless steel, aluminum or other material that resists corrosion. The dust shield 22 is also an improvement to seal from foreign debris and is preferably made from silicone impregnated fibers.

The actuator 23 is located under the dust shield 22. The underside of the actuator includes another improvement consisting of a silicon membrane 24. The silicon membrane has a pressure relief 30 slit or opening that relieves changes in pressure within the switch as an aircraft changes elevation. The switch contacts cavity is sealed completely with silicone gel. A center bearing 25 can operate on an optional silicone displacer 26. The silicone displacer 26 reduces the free air volume within the switch to reduce the volume of air movement in and out of the switch from pressure change in an aircraft. These pieces are held within a switch body with gold terminals 29. The switch body 27 has a plurality of locks 31 on the outside of the switch body 27 that retains the switch 19 within an aircraft dashboard or console. The bottom of the switch 19 is sealed 28 and previously shown and described. The terminals 29 are preferably gold plated for improved electrical conduction through the switch terminals.

Figure 4:
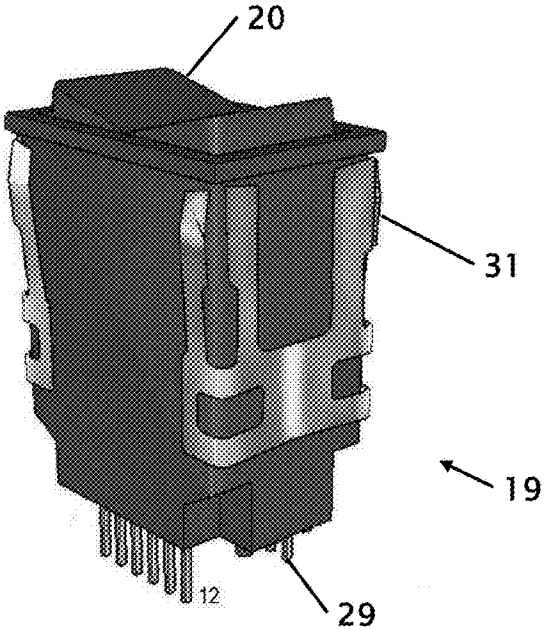
FIG. 4 shows a perspective view of the switch.

FIG. 4 shows a perspective view of the switch 19. Advantages of modifications to an existing switch include the fact that the switch 19 is popular with thousands already in service. By modifying the existing switch to enhance its environmental performance and giving it Foreign Object Debris (FOD) defense, the aircraft wiring harness and panel cutout area will remain unchanged to allow the rocker 20, spring terminal locks 31 and the electrical contact 29 to remain intact with the non-modified switch.

Figure 5:
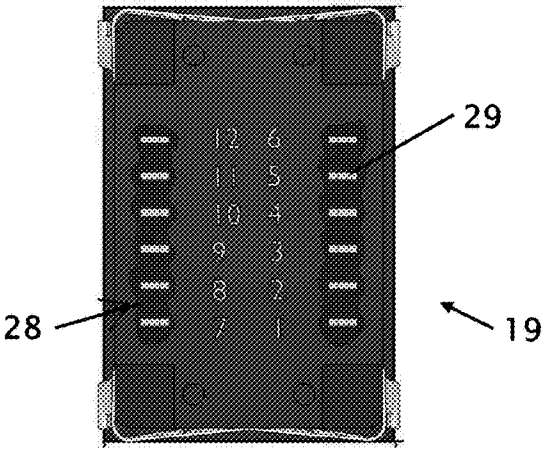
FIG. 5 shows a bottom view of the switch.
Figure 6:
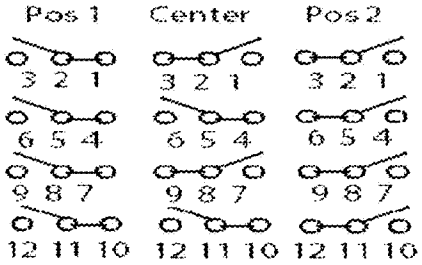
FIG. 6 shows a circuit diagram of the switch.

FIG. 5 shows a bottom view of the switch and FIG. 6 shows a circuit diagram of the switch. The wiring pins out of the switch will not change, allowing the easy replacement of the failure switch, and the pole position configurations are unique.

FIG. 7 shows the specifications for the switch and FIG. 8 shows a description of the process to produce the switch. This modification to the switch allows it to function as originally designed with the added FOD proofing. The detent and action of this rocker switch is essentially unchanged.

The method of the modification includes disassembling the switch by removing retaining clips, a test rocker button 20, an actuator spring 23, a pivot and a bearing 25 from a housing 27. Steam cleaning said actuator spring 23, said pivot and the bearing with deionized water. The parts are then inspected cleanliness after the steam cleaning.

The switch housing is then cooled to 40-55 degrees Fahrenheit. An adhesive 28 is the applied to the switch body 27 around electrical contacts and then curing the adhesive. The adhesive 28 is cured for about three hours at 184 degrees Fahrenheit.

The sealed housing is the pressure tested 17 psi using xtreme klean can difluoreothan. The seal is verified at a pressure of 19 to 20 psi with a bleedoff rate of 0.1 psi per second.

Silicone Q3 is mixed and outgasses. The outgassed silicone mixture is the cured for about 2 hours. The center bearing 25 is installed and bonded to the gasket 24, and then allowed to cure for about 6 hours.

The actuator 23 and the spring is then installed. The dust shield 22 and bezel 21 is installed with an adhesive. The test rocker button 20 is also installed and the fit with the rocker dust shield is checked.

The clips are then installed ant the modified switch assembly is the thermally cycled and the modified switch is tested and inspected. The results of all testing is recorded.

The modification to the switch protects it from foreign debris and other material entering into, and causing interference between the switch contacts. This switch modification does not completely stop debris from entering the switch body, but does not allow debris to interfere with the crucial contact area.

Modification by the addition of the dust shield protects the switch from fluids and debris, and a further inner membrane that has altitude change relief protects internal moving part from FOD.

FIG. 9 shows a perspective view of the silicone membrane 90. The membrane has a pressure relief portion 91 which allows for changes caused by altitude variation. A hole 92 locates the silicon membrane and seals the area around the contacts.

The modification limits size of debris from entering the body of the switch that would cause a malfunction, after the modification sealing up the switch, it is then able to pass the harsh mil spec sand and dust test, and the mil spec altitude test. This was not achievable by utilizing a flexible boot over the switch. The boot changes the detent on the switch and was not acceptable to the customer, the boot also left areas of the switch open and allowed contacts to fail because the switch has difficulty passing altitude testing.

This modification improved the switch by adding components that allow the switch to meet the mil spec sealed status by passing the sand and dust, moisture, salt spray and altitude tests. The modification will allow the high failure rate of the un-modified switch to cease.

Thus, specific embodiments of a modified or manufactured aircraft switch have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A method of modifying an aircraft switch comprising:
- disassembling a switch by removing retaining clips, a test rocker button, an actuator spring, a pivot and a bearing from a housing;
- steam cleaning said actuator spring, said pivot and said bearing with deionized water;
- applying an adhesive to said switch body around electrical contacts and allowing said adhesive to cure;
- pressure testing said housing;
- outgassing a silicon mixture;
- installing said center bearing and bonding a gasket into said housing;
- installing said actuator and said spring into said center bearing;
- installing a dust shield and a bezel onto said actuator, and adding an adhesive;
- installing said test rocker button, and
- installing said retaining clips.

2. The modified aircraft switch according to claim 1, wherein curing of said adhesive is by baking.

3. The modified aircraft switch according to claim 2, wherein said baking is at 184 degrees Fahrenheit.

4. The modified aircraft switch according to claim 2, wherein said baking is for three hours.

5. The modified aircraft switch according to claim 1, further includes testing a modified switch.

6. The modified aircraft switch according to claim 1, wherein bonding said gasket to said center bearing further includes curing said bonding agent.

7. The modified aircraft switch according to claim 6, wherein said curing of said bonding agent is in an incubator.

8. The modified aircraft switch according to claim 1, further includes verifying a fit of said dust shield with said test rocker button.

9. The modified aircraft switch according to claim 1, further includes inspecting said switch for cleanliness after said steam cleaning.

* * * * *